United States Patent [19]

Roth

[11] 4,285,167

[45] Aug. 25, 1981

[54] ARBOR FOR MOUNTING TOOLS IN A CHUCK

[75] Inventor: Robert B. Roth, New York, N.Y.

[73] Assignee: Sandvik Coastal Inc., Fair Lawn, N.J.

[21] Appl. No.: 101,281

[22] Filed: Dec. 7, 1979

[51] Int. Cl.[3] ..... B24B 23/02; B24D 13/20

[52] U.S. Cl. ..... 51/168; 51/378; 411/437; 411/527

[58] Field of Search ..... 51/168, 170 T, 170 PT,376, 51/378, 379, 358, 209 R; 85/36, 32 V, 61

[56] References Cited

U.S. PATENT DOCUMENTS

| | | | |
|---|---|---|---|
| 2,252,932 | 8/1941 | Johnson | 85/32 V |
| 2,400,848 | 5/1946 | Soderberg | 51/168 |
| 3,073,107 | 1/1963 | Haydon | 85/36 |
| 3,139,709 | 7/1964 | Walters | 51/379 |
| 3,436,875 | 4/1969 | Cheney | 51/376 |
| 3,803,771 | 4/1974 | Bunn | 51/170 T |
| 4,015,371 | 4/1977 | Grayston | 51/209 R |

FOREIGN PATENT DOCUMENTS

| | | | |
|---|---|---|---|
| 1451937 | 7/1966 | France | 51/168 |

*Primary Examiner*—Leonidas Vlachos

*Attorney, Agent, or Firm*—Ostrolenk, Faber, Gerb & Soffen

[57] ABSTRACT

The disclosure concerns an arbor for securing a tool, or other rotating device to a chuck of a drill or the like. The arbor comprises a stamped member folded to have an upper wall with an opening therein to receive a screw in order to secure the tool to the upper wall, and side wings from opposite sides of the upper wall are bent down toward each other. The portions of the wings adjacent the upper wall are flat for being grasped by a tool, like a wrench. The upper portions of the wings further from the upper wall are curved to receive and guide the shaft of an inserted tool fastening screw. The lower portions of the wings shaped so that they meet each other along the lateral edges and so that they provide a chuck engaging member of hexagonal cross-section. The upper wall is cambered for driving the lower portions of wings together as the tool is tightened onto the arbor.

17 Claims, 8 Drawing Figures

ARBOR FOR MOUNTING TOOLS IN A CHUCK

BACKGROUND OF THE INVENTION

The present invention relates to an arbor for mounting tools, e.g. grinding stones, wire brushes, polishing, sanding or grinding discs, etc., in a chuck of a tool, like a power tool such as an electric drill, and the invention particularly relates to a stamped arbor which is folded into its final shape, which has a final shape wherein it is longitudinally split along the portion where the chuck engages the arbor and which has a profiled cross-sectional shape along that portion so that the arbor is less likely to slip in the chuck.

Heretofore, it has been customary to make an arbor of a solid piece of metal. The arbor is typically countersunk, and the resulting bore in the arbor is threaded in order to receive a screw to secure the tool to one end of the arbor. The arbor has an integral extending shank, which is usually cylindrical in cross-section, for engagement by the chuck of the tool. The outside of the known arbor is profiled at its end away from the chuck engaging end so that a wrench might be used for holding the arbor while the tool securing screw is tightened into the threaded bore in the arbor. The known arbor is rigid in construction. It is sometimes possible for the arbor to slip with respect to the chuck.

SUMMARY OF THE INVENTION

The present invention relates to an arbor which is preferably made of sheet metal and which is preferably formed by being stamped and then bent to define its final shape.

Means for securing a tool to the arbor comprise a screw threaded receptacle which is defined by tabs which are formed around a central opening into the top of the arbor. The tabs are bent down to provide the equivalent of a screw thread. A tool can then be attached to the arbor by a securing element, i.e. a screw. The screw is received inside the completed arbor and its orientation is guided by the internal wall of the arbor.

Wings or side extensions of the stamping extend out from what becomes the top of the arbor and are bent down next to each other to be substantially parallel to each other. The wings are shaped or profiled in the stamping process to provide support for the top of the arbor and the tool thereon.

Just beneath the top of the arbor, the wings are shaped to profile the arbor for being engaged by a wrench.

The lateral edges of the wings extend toward each other and each cooperating pair of edges forms a respective seam along the length of the arbor. A pair of seams are thus formed along diametrically opposite sides of the arbor.

Beneath the wrench engageable portion of the arbor, the wings are shaped so that their cooperating opposed interior walls define a guide for orienting an inserted screw.

Beneath the screw guiding section, the wings are shaped to together define a profiled, preferably polygonal and more preferably hexagonal cross-section end portion, remote from the top or upper wall of the arbor, for engagement by the chuck. Because of this hexagonal shape, the chuck will engage the flat sides of the wings defining the hexagonal cross-section. As the chuck closes in on the arbor, the arbor is automatically positioned by the inward pressure of the jaws of the chuck so that the chuck jaws will engage the smallest diameter, along the sides of the arbor. If the shank of the arbor were round and were longitudinally seamed, the arbor shank would not always fit correctly into the generally utilized three jawed chuck, and the chuck could close on one of the seams, possibly resulting in an off center grip and vibration due to tool eccentricity.

The primary object of the present invention is the provision of an effective arbor for use in supporting a tool and for being received in a chuck.

Another object of the invention is to obtain a secure grip by a chuck upon the arbor and to reduce slippage of the arbor.

BRIEF DESCRIPTION OF THE DRAWINGS

The foregoing and other objects and features of the present invention will become apparent in the following description and drawings in which.

DESCRIPTION OF THE PREFERRED EMBODIMENT

Figure 2A:
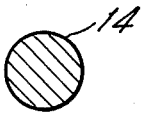
FIG. 2A. PRIOR ART
FIG. 2A is a cross-sectional view taken on line 2A—2A of FIG. 2.
Figure 2:
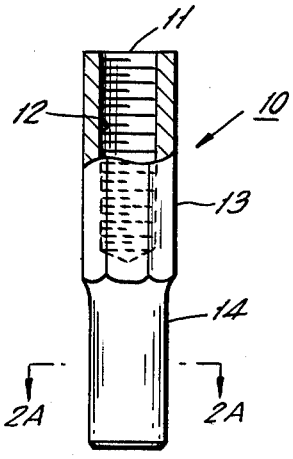
FIG. 2. PRIOR ART
FIG. 2 is a view partly in cross-section of an arbor of the prior art.

Referring to FIGS. 2 and 2A, the arbor used in the prior art comprises an integral solid metallic shaft 10 which is countersunk at 11 at its top and the resulting bore 12 is provided with screw threads. At its upper end, the arbor 10 is hexagonally profiled at 13 for being firmly grasped by a wrench while a screw is being tightened into the bore 12 for securing a tool to the arbor. Beneath the profiled section 13, the arbor has an extending shaft 14 of circular cross-section, which is to be engaged by the chuck of a tool, such as a power drill (not shown). This arbor may be costly in production. Also, the chuck may not be able to hold the arbor against slippage during use.

Referring to FIGS. 1 and 3 to 7, the novel arbor of the present invention is illustrated. It is formed from a single stamped piece of metal. The width of the piece of metal is selected so that when the below described wings 20, 30, 36, on the one hand, and 21, 31, 37, on the other hand, are profiled to form the circular 28 and the hexagonal 38 cross-section sections of the arbor, each wing provides one half of the circumference of the arbor sections. The length of the piece of metal, of course, determines the length of the completed arbor.

The arbor includes an upper wall 15 that is centrally located along the length of the arbor. The upper wall has an opening 16 formed in it, which has peripheral tabs 17, that are bent down from the edge of the opening, extending into the opening and the tabs are so arranged as to provide an appropriate thread for receiving the thread of the screw 18. The screw 18 secures an operating tool, such as a sanding disc and its flange support 50, to the upper wall 15 of the arbor. An arbor upper wall engaging washer 51 is included beneath the flange support 50 for pressing against the arbor upper wall 15, for the reason described below.

Figure 3:
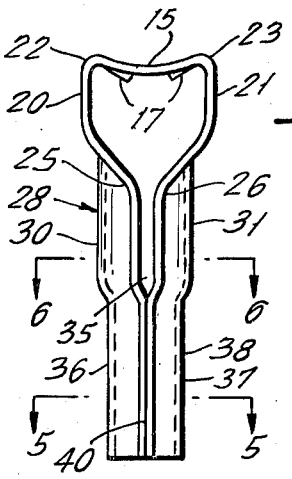
FIG. 3 is an enlarged elevational view of the arbor of FIG. 1.

The arbor upper wall 15 is not flat. Instead, as shown in FIG. 3, it is slightly cambered or has slight inclines toward both opposite edges 25, 26. When the screw 18 is tightened, the washer 51 is pressed down on the upper wall 15 as the upper wall tabs 17 are drawn up. The abutment between the washer 51 and the cambered upper wall 15 flattens the upper wall, which drives the free ends of the wings of the arbor at section 38 together.

The stamped metal piece of which the arbor is comprised is bent down on the lines 22 and 23 to define beneath the upper wall 15, two upper wing sections 20 and 21 at opposite sides of the upper wall 15. The upper wing sections 20 and 21 are short in height and are flat or undeformed, so that a wrench can grasp the arbor around sections 20, 21 and hold the arbor stationary while a screw is being tightened into the opening 16.

Figure 1:
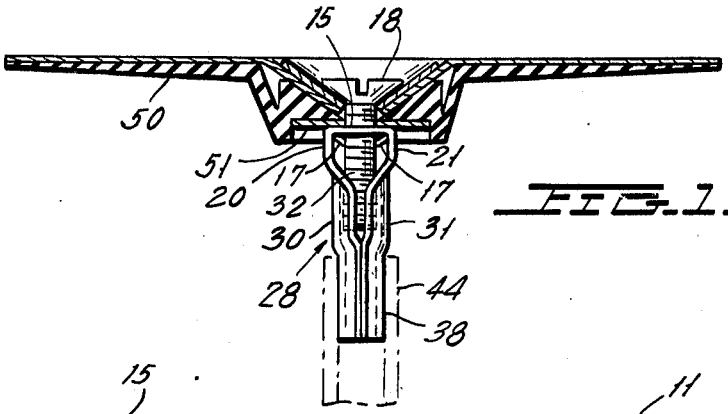
FIG. 1 is an elevational view of the arbor of the present invention shown supporting a tool and received in a chuck.
Figure 4:
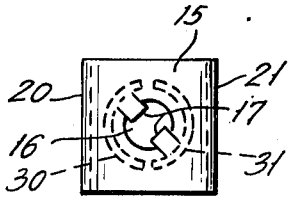
FIG. 4 is a top view of the arbor of FIG. 3.
Figure 6:
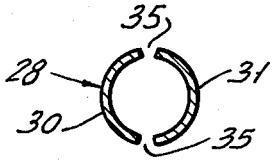
FIG. 6 is a cross-sectional view taken on line 6—6 of FIG. 3 looking in the direction of the arrows.
Figure 5:
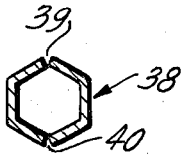
FIG. 5 is a cross-sectional view taken on line 5—5 of FIG. 3 looking in the direction of the arrows.

Beneath the flattened upper wing sections 20 and 21, the bent down wings of the arbor are curved inwardly toward each other at their opposed lateral edges 25 and 26, respectively. The opposed lateral edges at one side can be seen. Those on the opposite side are the same. This deformation of the wings forms a supporting structure 28. Here, the wing sections 30 and 31 are each shaped with the same profile and together they define a structure 28 of substantially circular cross-section. The inner diameter of this circular section is substantially the same as the outer diameter of the threaded shank 32 of the screw 18 which fastens the tool 50 to the arbor. Thus, the inserted screw is properly oriented by the structure 28 and is prevented from canting around the screw tabs. Because of the diameter of the screw shank 32, the wing sections 30, 31, as shown in FIGS. 1, 3 and 6, are spaced from each other by the gaps 35 on diametrically opposite sides. But, because of their curvatures the wing sections 30, 31 provide substantial support for the upper wall 15 of the arbor.

Figure 7:
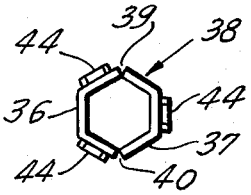
FIG. 7 is a view corresponding to FIG. 5 showing the manner in which the chuck engages the arbor of the invention.

At the lower end of the arbor beneath the wing sections 30, 31, the wings of the arbor are shaped at lower sections 36, 37 so that together they form the hexagonal cross-sectional section 38. The lateral edges of the wings meet at the longitudinal seams 39, 40 at opposite sides of the arbor. As noted above, the cambered upper wall causes the opposed lateral edges at each side of the arbor wings at section 38 to stay together making an effectively unitary structure. In addition, the pressure of the jaws of the chuck hold the wings together. The section 38 of the arbor is to be received by the tool chuck jaws 44, as shown in FIGS. 1 and 7. As the three jaws of the chuck close down on the hexagonal section 38 of the arbor, the jaws automatically cam or rotate the arbor as they close down on the flats of the hexagonal section because the flats are diametrically closer to each other than the apices or angles at which the wings meet.

The arbor thus formed may be shaped from a simple sheet of cut and stamped metal of uniform width, which may be bent and stamped to define its various sections. It is not necessary to form a solid arbor and then countersink and thread it. Furthermore, the arbor of the invention is readily engageable by a chuck and it is quite able to engage and retain the tool which is to be attached thereto.

In the foregoing, the present invention has been described in connection with an illustrative embodiment thereof. Since many variations and modifications of the present invention will now be obvious to those skilled in the art, it is preferred that the scope of this disclosure be determined not by the specific embodiment illustrated herein but only by the appended claims.

What is claimed is:

1. An arbor for supporting a tool to itself and for being received by a chuck of another object, said arbor comprising an upper wall for supporting a tool to said arbor and a pair of side wings bent substantially normally to said upper wall; said wings being substantially parallel to each other; said wings each having opposite lateral edges, respectively; said wings having respective end portions remote from said upper wall; said wings at said end portions being shaped so that each said lateral edge on each said wing extends toward a cooperating said lateral edge on the other said wing; at said end portions, said wings being further shaped so as together to form a structure of a profiled cross-section, which said structure is engageable by a chuck.

2. The arbor of claim 1 wherein said end portions are shaped to together form a structure of polygonal cross-section.

3. The arbor of either of claims 1 or 2, wherein said upper wall is generally rectangular in shape, and said wings extend down from two opposite sides of said upper wall; said wings being flat at said upper wall and for a short distance beneath said upper for defining a top portion of said arbor adapted to be grasped by a securement tool.

4. The arbor of claim 2, wherein said polygonal cross-section of said end portions is a hexagonal cross-section.

5. The arbor of claim 1, wherein said wings are flat plates which are bent into their said profiled cross-section.

6. The arbor of either of claims 1 or 5, wherein said arbor is comprised of a unitary piece of metal including said upper wall and said wings, and said piece of metal is entirely of uniform width from one wing, over said upper wall through the other said wing.

7. The arbor of claim 6, wherein said arbor is comprised of a single stamped piece of metal.

8. The arbor of either of claims 1 or 4, wherein said arbor is comprised of a single stamped piece of metal.

9. The arbor of claim 8, wherein said wings are flat plates which are bent into their said profiled cross-section.

10. The arbor of claim 1, wherein said upper wall is provided with securing means for securing a tool to said upper wall of said arbor.

11. The arbor of claim 10, wherein said opening is provided with tabs forming means for receiving a screw thread, and said securing element comprises a screw having a thread engageable with said screw receiving means; said screw being adapted to secure a tool to said arbor upper wall.

12. The arbor of claim 10, wherein said securing means comprises an opening in said upper wall and a securing element received in said opening for securing a tool to said upper wall of said arbor.

13. The arbor of either of claims 11 or 12, wherein said upper wall is cambered, such that as a tool is secured to said upper wall by said securing element, said upper wall is flattened from its cambered condition, whereby said wings are driven toward each other.

14. The arbor of either of claims 10 or 12, wherein said wings at upper portions thereof nearer to said upper wall, are curved toward each other in order to define an enclosure having an inner wall and into which said securing element is inserted; said enclosure having an inner diameter such that said securing element is engaged and guided by said inner wall of said enclosure as said securing element is inserted in said enclosure; said upper portions merging into said end portions remote from said upper wall.

15. The arbor of claim 14, wherein said upper wall is generally rectangular in shape, and said wings extend down from two opposite sides of said upper wall; said wings being flat at said upper wall and for a short distance beneath said upper for defining a top portion of said arbor adapted to be grasped by a securement tool.

16. The arbor of claim 15, wherein said wings are flat plates which are bent into their said profiled cross-section; said top portion being between said upper portion and said upper wall.

17. The arbor of claim 16, wherein said upper wall is cambered, such that as a tool is secured to said upper wall by said securing element, said upper wall is flattened from its cambered condition, whereby said wings are driven toward each other.

* * * * *